US005678686A

United States Patent [19]

Hagemann et al.

[11] Patent Number: 5,678,686

[45] Date of Patent: Oct. 21, 1997

[54] GUN CASE

[75] Inventors: John J. Hagemann; James Schumaker, both of Plano, Ill.

[73] Assignee: Plano Molding Company, Plano, Ill.

[21] Appl. No.: 596,074

[22] Filed: Feb. 6, 1996

[51] Int. Cl.[6] ..... B65D 85/00

[52] U.S. Cl. ..... 206/315.11; 206/317

[58] Field of Search ..... 206/317, 315.11, 206/443

[56] References Cited

U.S. PATENT DOCUMENTS

| | | | |
|---|---|---|---|
| 750,817 | 2/1904 | Crenshaw | 206/317 |
| 784,601 | 3/1905 | Taylor | 206/317 |
| 2,487,528 | 11/1949 | Dawson | 206/317 |
| 2,512,622 | 6/1950 | Fish | 206/317 |
| 2,519,662 | 8/1950 | Kempken | 206/317 |
| 2,774,563 | 12/1956 | Pribis | 206/317 |
| 2,781,897 | 2/1957 | Dale | 206/317 |
| 2,877,689 | 3/1959 | Pribis | 206/317 |
| 3,907,108 | 9/1975 | Weimer, Jr. | 206/317 |
| 5,058,302 | 10/1991 | Minneman | 206/315.11 |

*Primary Examiner*—Jimmy G. Foster

*Attorney, Agent, or Firm*—Jack D. Nimz; Richard A. Zacher

[57] ABSTRACT

A gun case is provided having rigid walls for vertically storing and transporting a gun having a one or two piece wooden or plastic stock including rear stock and fore stock portions. The gun case includes an upper case portion matable with a lower case portion. First and second resilient cradles having, respectively, first and second U-shaped, angled channels are disposed within the lower case portion. The first U-shaped channel is adapted to support the gun in spaced relation from the walls of the case whereby the first resilient cradle will only engage the rear stock portion. Similarly, the second U-shaped channel is adapted to support the gun in spaced relation from the walls of the case whereby the second resilient cradle will only engage the fore stock portion. At least one lockable strap is preferably provided and is secured to the lower case portion for use in urging the gun into supportive engagement with the first and second cradles when the gun is disposed within the case.

18 Claims, 3 Drawing Sheets

4
5
6
7
8
12
14
16
18
19
24
26
34
36
38
42
44
48

GUN CASE

BACKGROUND OF THE INVENTION

This invention relates generally to gun cases of rigid construction and, more particularly, relates to a gun case for use in the storage and transport of rifles, shotguns, or other guns ("gun").

Gun cases are intended in part to protect guns from physical damage during transport and storage as well as from the corrosive effects of moisture when the guns are not in use. To accomplish this function, gun cases of rigid construction typically incorporate internal padding which is used to protect the gun during transport. Specifically, the gun is sandwiched between the padding when the case is closed to thereby prevent movement of the gun and hence reduce physical damage during transportation. As such, major portions of the gun are contacted by the internal padding material. To further assist in the securing of the gun within the case it is not uncommon for this internal padding to be configured to mate with a particular type of gun whereby one and only one type of gun may be secured therein.

An example of a rigid gun case utilizing a non-configured, foam padding may be seen in U.S. Pat. No. 3,811,562, issued on May 21, 1974, to Smith. The gun case disclosed in the '562 patent is further typical of known, commercially available gun cases in that it is of the "clam shell" variety, i.e. the gun case is designed to be opened and closed while resting on its side.

With respect to the currently available, commercial, rigid gun cases there has been seen a common problem in that the material used for the internal padding readily absorbs and retains moisture from the atmosphere and/or the environment. As such, if a gun is stored for a prolonged period in such a gun case the metal portions of the gun, which are in direct contact with the padding material, tend to suffer from discolorization and, in a worst case, rust. Furthermore, the forces applied by the padding material upon the gun as the gun case is closed have the tendency to throw a carefully calibrated, telescopic sight out of alignment should such a sight be attached to the gun during storage and/or transportation.

Thus, while rigid gun cases have long been available, a need still remains for an improved rigid gun case which is capable of storing, securing, and transporting guns of various dimensions and types. As a result of this existing need, it is an object of the present invention to provide such a rigid gun case which overcomes the deficiencies above-described with respect to single gun type accepting cases, moisture absorption, and sight alignment. It is a further object of the present invention to provide a gun storage and transportation case which can be manufactured at a relatively low cost so as to be retailable at a modest price.

SUMMARY OF THE INVENTION

In accordance with the present invention, a gun case is provided having rigid walls for internally storing and transporting a gun having a one or two piece wooden or plastic stock including a rear stock and fore stock portions, a set of cradles disposed within the case having surfaces for supportingly engaging only the stock portions of the gun whereby the cradles are orientated to engage the gun while the gun is in an upright position spaced from all the walls within the case, and a strap, cooperable with the cradles, for maintaining the gun in its upright position.

In the preferred embodiment of the invention, the gun case includes an upper case portion matable with a lower case portion in a top-open configuration. First and second resilient, foam cradles having, respectively, first and second U-shaped channels are disposed within the lower case portion. The first U-shaped channel is adapted to support the gun in spaced relation from the walls of the case whereby the first resilient cradle will only engage the rear stock portion. Similarly, the second U-shaped channel is adapted to support the gun in spaced relation from the walls of the case whereby the second resilient cradle will only engage the fore stock portion. At least one lockable strap is preferably provided and is secured to the lower case portion for use in urging the gun into supportive engagement with the first and second cradles when the gun is disposed within the case for maintaining the gun in a vertical orientation. In addition, the first and second cradles are provided with wedge shapes for preventing lateral movement of a gun secured thereon.

A better understanding of the objects, advantages, features, properties and relationships of the invention will be obtained from the following detailed description and accompanying drawings which set forth an illustrative embodiment and is indicative of the various ways in which the principles of the invention may be employed.

BRIEF DESCRIPTION OF THE DRAWINGS

For a better understanding of the invention, reference may be had to the preferred embodiment shown in the following drawings in which.

DETAILED DESCRIPTION

While the invention can be used in conjunction with most guns it will be described hereinafter in the context of a rigid case for use in storing and transporting a shotgun or rifle as the preferred embodiment thereof.

Figure 1:
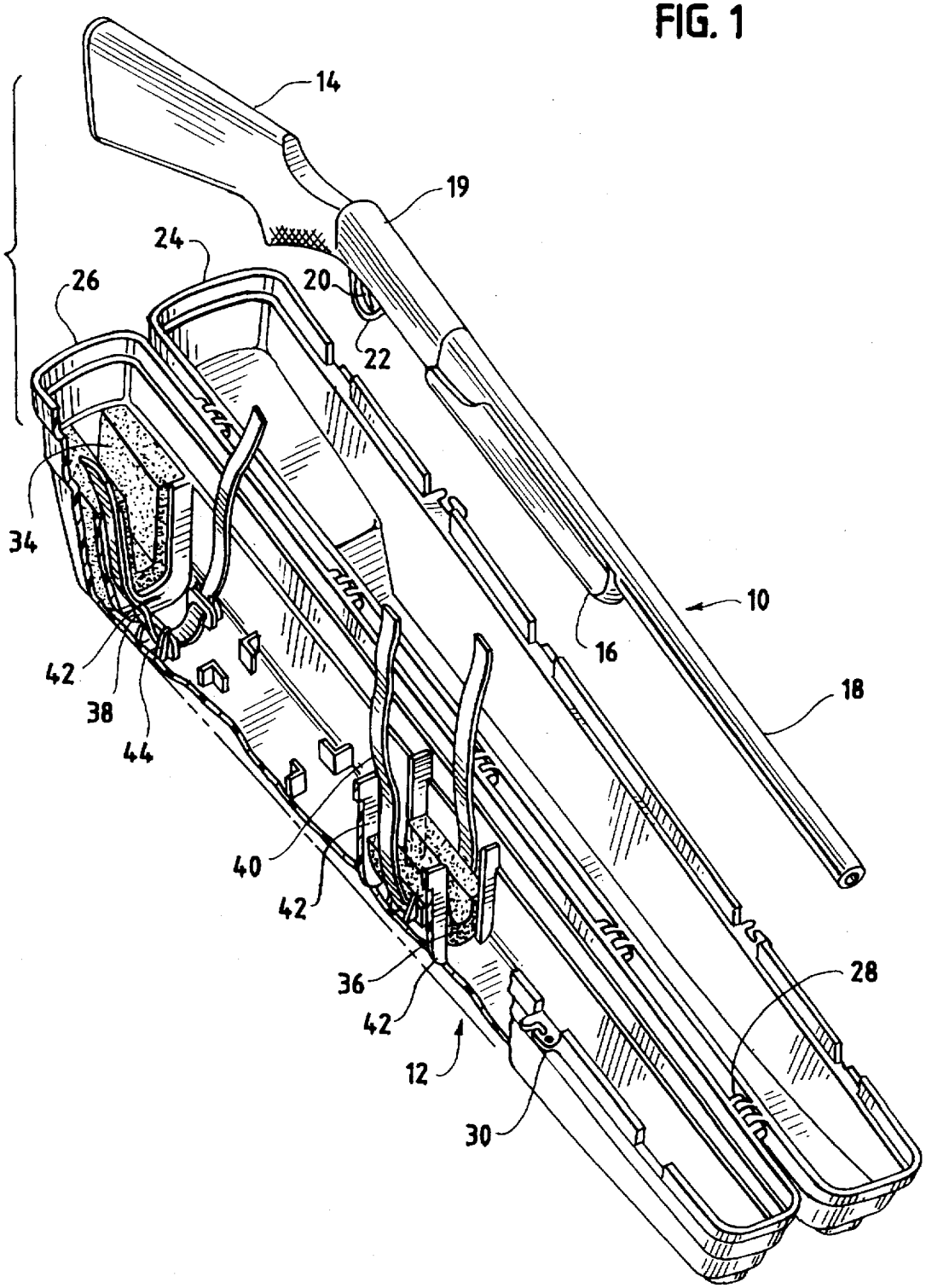
FIG. 1 illustrates a perspective view illustrating a gun case in accordance with the present invention without a gun disposed therein.
Figure 2:
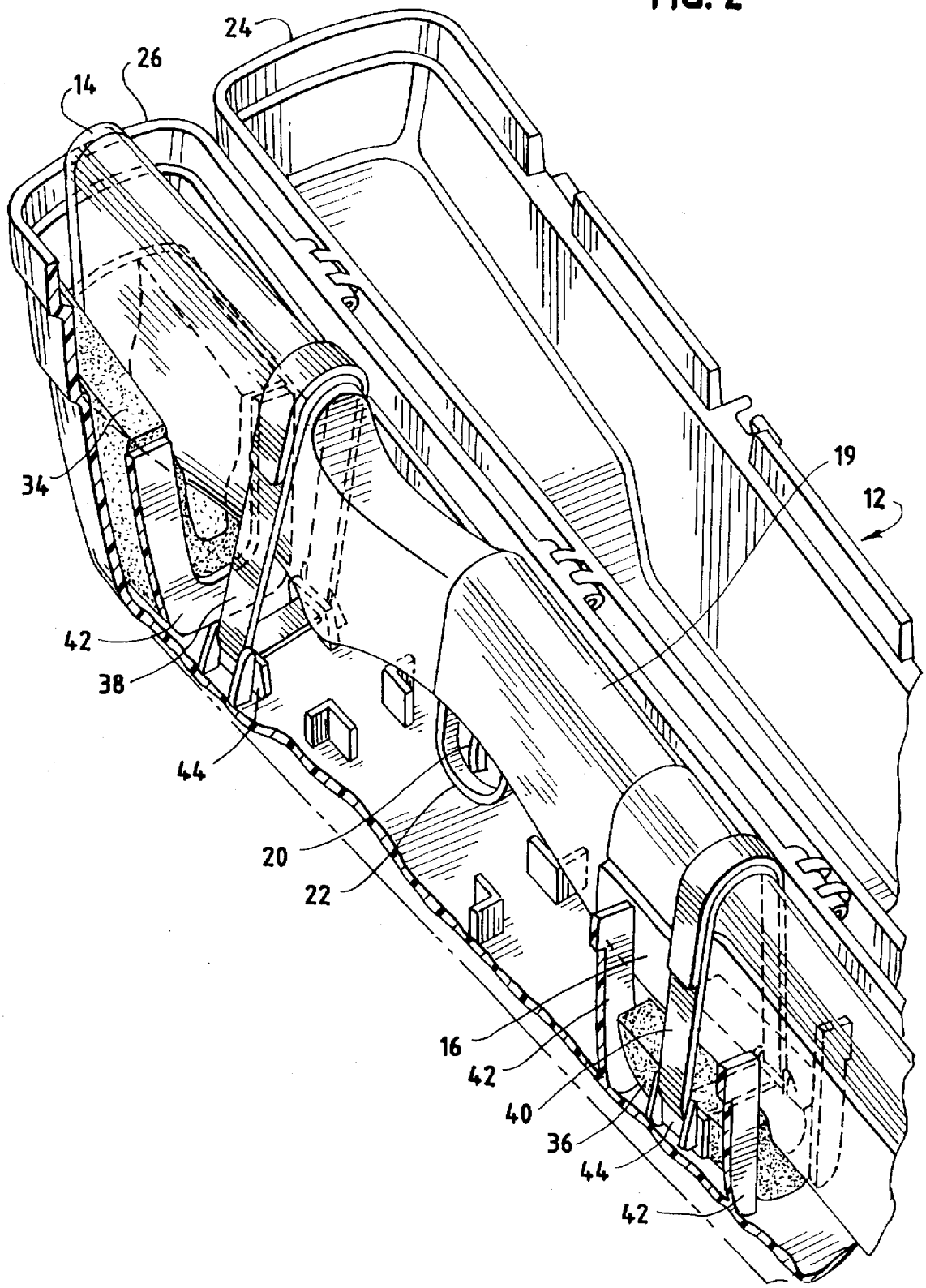
FIG. 2 illustrates a fragmentary, perspective view of the gun case illustrated in FIG. 1 wherein the gun is disposed therein.

Referring now to the figures, wherein like reference numerals refer to like elements, there is shown generally a gun 10 and a gun case 12. The gun 10 includes a one or two piece wooden or plastic stock including a rear stock portion 14 and fore stock portion 16. The remainder of the gun is constructed from metal and typically includes an elongated barrel 18, receiver 19, trigger 20, and trigger guard 22. The gun case 12 generally includes an upper case portion 24 and a lower case portion 26 both of which may be molded from plastic or constructed from a rigid material. The upper case portion 24 and the lower case portion 26 are connected via hinge assemblies 28 whereby the upper case portion 24 can be swung between a closed position, generally illustrated in FIG. 4, and an open position, generally illustrated in FIGS. 1 and 2. A series of clasps or latches 30 are preferably provided opposite the hinge assemblies 28 to secure the upper case portion 24 and the lower case portion 26 in closed relation. A handle 32 may also be attached to the upper case portion 24 and would preferably be aligned over the proximate center of gravity of the case when a gun 10 is contained therein whereby tilting of the case during transport is avoided. The lower case portion 26 is preferably provided with a depth sufficient to maintain the majority of the gun 10 therein while the upper case portion 24 is provided with enough depth to accommodate the remainder of the gun 10 and a telescopic scope, should one be attached to the gun 10, in spaced relation therefrom.

Figures 3, 4, 5, 6, 7, 8:
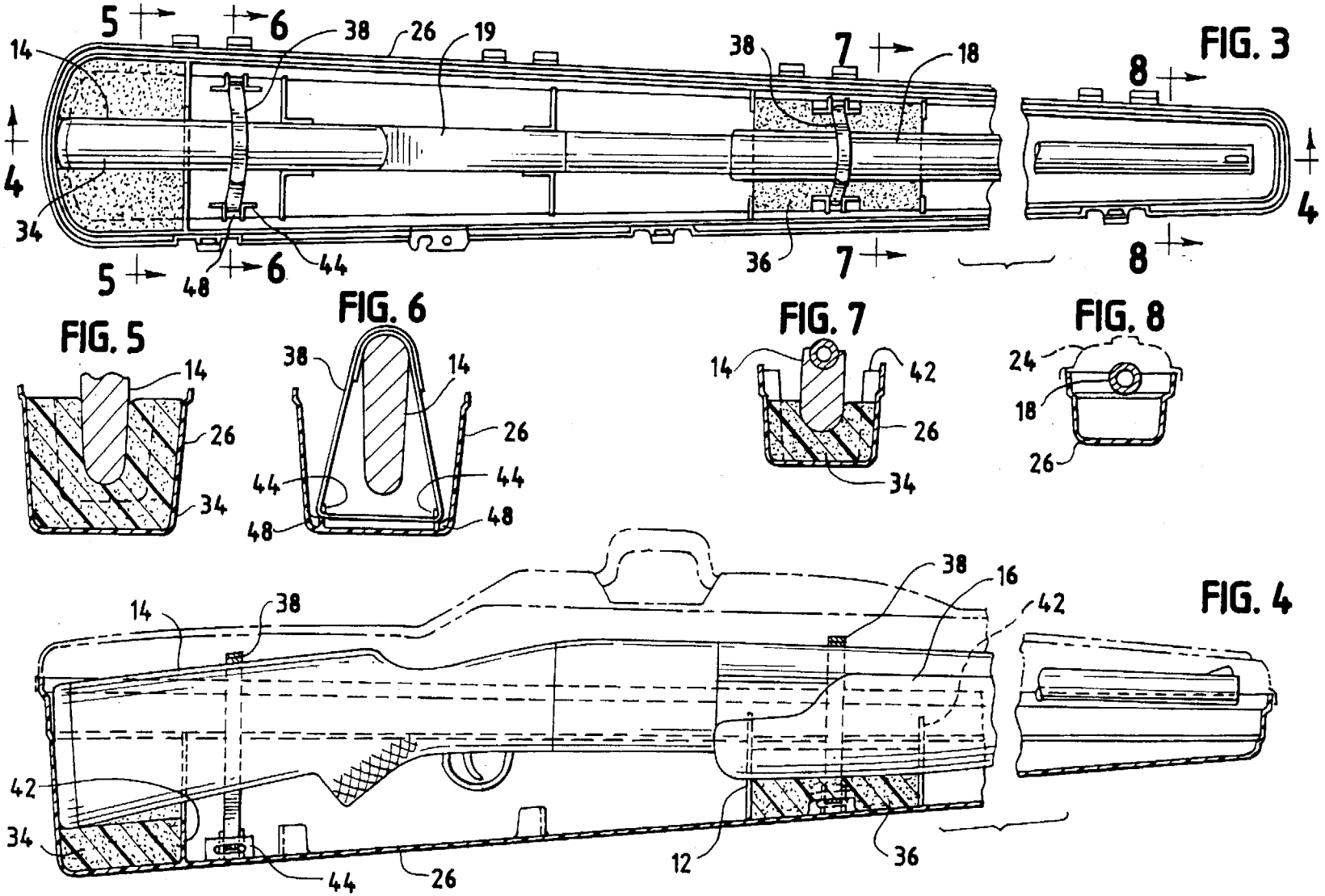
FIG. 3 illustrates an overhead view of the gun case illustrated in FIG. 1 containing a gun.
FIG. 4 illustrates a side view of the gun case illustrated in FIG. 1 containing a gun.
FIG. 5 illustrates a sectional view of the gun case along line 5—5 of FIG. 3.
FIG. 6 illustrates a sectional view of the gun case along line 6—6 of FIG. 3.
FIG. 7 illustrates a sectional view of the gun case along line 7—7 of FIG. 3.
FIG. 8 illustrates a sectional view of the gun case along line 8—8 of FIG. 3.

To assist in maintaining the gun 10 within the case 12, the case 12, specifically the lower case portion 26, is provided with a pair of foam cradles 34,36 and a pair of tie down straps 38,40. As illustrated in FIG. 4, a first of the foam cradles 34 is preferably positioned at the rear end of the lower case portion 26 while the second of the foam cradles 36 is positioned approximately midway between the middle and the front of the lower case portion 26. This positioning of the foam cradles 34,36 is provided such that the first foam cradle 34 will only engage the rear stock portion 14 and the second foam cradle 36 will only engage the fore stock portion 16 when the gun 10 is supported thereon. While not required, each of the foam cradles 34,36 may be secured to the lower case portion 26 through the use of a conventional adhesive. In addition, the foam cradles 34,36 may be maintained within the case by being wedged between stops which will be described hereinafter.

To further assist in maintaining the respective positions of the foam cradles 34, 36 and to prevent any lateral movement thereof, the lower case portion 26 may also be provided with a plurality of stops 42 between which the foam cradles 34,36 are positioned. The first foam cradle 34 may utilize only one such stop 42 where the rear wall of the lower case portion 26 may function as the other stop between which the first foam cradle 34 is positioned. With such a configuration the first foam cradle 34 may be sized and arranged to provide a foam layer between the rear wall and the butt of the gun when the gun is disposed within the case. The stops 42, if utilized, may be integrally formed during the molding process of the lower case portion 26 or may be separately attached.

Each of the foam cradles 34,36 are preferred to have a generally U-shape channel disposed along the length thereof for accommodating the insertion therein of the gun 10 whereby the gun 10 will be prevented from making contact with the sides of the case 12. Specifically, the depth of the U-shaped channel and the thickness of the foam cradles 34,36 should be sufficient to securely accommodate a gun vertically therein whereby any contact with the lower case portion 26 during movement is prevented. Furthermore, with respect to the second foam cradle 36, it is desirable to limit the proportions thereof such that the barrel 18 will not become engaged therewith when the gun 10 is inserted within its U-shaped channel.

To assist in the prevention of lateral movement of the gun 10 when the gun 10 is positioned within the U-shaped channels, it is also preferred that each of the U-shaped channels be positioned at an angle with respect to the bottom of the lower case portion 26 whereby each of the foam cradles 34,36 attains a substantially wedge shaped bottom supporting surface. In particular, the first foam cradle 34 is preferably provided with a U-shaped channel that angles downward in the direction of the rear of the lower case portion 26 whereby the wedge shaped supporting surface will cooperate with the angled bottom of the rear stock portion 14 to prevent the gun 10 from moving laterally forward. Similarly, the second foam cradle 34 is preferably provided with a U-shaped channel that angles downward in the direction of the front of the lower case portion 26 whereby the wedge shaped supporting surface will cooperate with the fore stock portion 16 to prevent the gun 10 from moving laterally backward. For accommodating most of the popular makes and styles of rifles and shotguns it is preferred that the first foam cradle be provided with an angle of approximately 13 degrees relative to horizontal and the second foam cradle be provided with an angle of approximately 3.5 degrees relative to horizontal with the distance between the centers of the first and second foam cradles being approximately 24.75 inches. In this manner, most makes and styles of rifles and shotguns may be supported within the case such that the need to provide specialized internal padding configured to mate with a particular type of gun is substantially eliminated.

As discussed previously, a pair of straps 40,42 are also preferably provided to cooperate with the foam cradles 34,36 for maintaining the gun 10 within the lower case portion 26. In the illustrated embodiment, a first strap 38 is provided in front of the first foam cradle 34 while the second strap 40 is positioned around the second foam cradle 36. It is to be understood, however, that these strap positions are illustrative only and any number of straps in any number of positions may be utilized. Each of the straps 38,40 is further provided with a locking means, such as VELCRO or the like, whereby the straps 38,40 may be securely locked around the gun 10 after the gun 10 is positioned upon the foam cradles 34,36. Specifically, the straps 38,40 are utilized to urge the gun 10 into the U-shaped channels of the foam cradles 34,36 and to prevent any upward movement of the gun 10 whereby contact with the upper case portion 24 is avoided. As such, it is seen that the upper case portion 24 need not be provided with any internal padding. It is further contemplated that the upper case could have attached thereto an engaging protrusion or similar type of device constructed from a rigid or non-water retaining material for use in urging the gun into the foam cradles when the upper case portion is closed over the gun.

To attach the straps 38,40 to the lower case portion 26 the lower case portion 26 is provided with a plurality of strap connectors 42 which may be integrally molded with the lower case portion 26 or attached thereto by conventional means. The strap connectors 44 are each provided with an opening 46 through which the respective strap passes for linking said strap to the lower case portion 26. In addition, each of the strap connectors 44 may also be provided with curved ribs 48 which are utilized to guide the straps into the respective openings. The curved ribs 48 are preferably molded onto the lower case portion 26 and travel from the side of the lower case portion 26 to the entrance of the opening 46 of each of the strap connectors 44.

As seen, the "top open" gun case 12 described herein is utilized to maintain the gun 10 in an upright position where the gun 10 is seen to be securely maintained in spaced relation from the interior of the rigid case 12 whereby only the rear stock portion 14 and fore stock portion 16 contact any foam support. As such, the present invention has, among other advantages, the advantage of preventing any contact between the metallic parts of the gun and any moisture retaining foam. Furthermore, the present invention has the advantage of not being limited to the accommodation of only one particular type of gun. In addition, the present invention has the advantage of allowing a gun having a scope attached thereto to be secured without having the alignment of the scope interfered with.

While specific embodiments of the invention have been described in detail, it will be appreciated by those skilled in the art that various modifications and alternatives to those details could be developed in light of the overall teachings of the disclosure. In particular, while a gun case has been illustrated for accommodating a single gun, it is contemplated that the above-described gun case could be modified to accommodate any number of guns while maintaining the spirit of the invention. Accordingly, the particular arrangements disclosed are meant to be illustrative only and not limiting as to the scope of the invention which is to be given the full breadth of the appended claims and any equivalent thereof.

What is claimed is:

1. In a gun case having rigid walls, the combination comprising:

a gun disposed within said case and having rear and fore stock portions in predetermined, spaced relation with respect to one another;

a first U-shaped cradle disposed within said case;

a second U-shaped cradle disposed within said case; and said first U-shaped cradle being positioned at a first location within said case and supportingly engaging said rear stock portion, said second U-shaped cradle being positioned at a second location within said case in said predetermined, spaced relation with respect to said first U-shaped cradle and supportingly engaging said fore stock portion, and the first and second U-shaped cradles having oppositely directed inclined surfaces supporting the gun in an upright orientation, said first and second cradles being configured to contact only the respective rear and fore stock portions of the gun.

2. The gun case as recited in claim 1, wherein said first and second cradles each comprise a U-shaped channel for use in supportingly engaging said rear stock and fore stock portions respectively therein.

3. The gun case as recited in claim 1, wherein said gun case further comprises an upper case portion matable with a lower case portion.

4. The gun case as recited in claim 3, wherein said first and second cradles are each disposed within said lower case portion and wherein said first and second cradle portions are each constructed from a resilient material.

5. The gun case as recited in claim 3, wherein said upper case portion is hingedly connected to said lower case portion.

6. The gun case as recited in claim 1, wherein said case further has associated therewith an urging means for urging said gun into supportive engagement with said first and second cradles.

7. The gun case as recited in claim 3, further comprising a handle attached to said upper case portion at a position substantially aligned over the center of gravity of said gun case when said gun is disposed therein.

8. The gun case as recited in claim 4, wherein said first and second cradles each comprise a U-shaped channel for use in supportingly engaging said rear stock and fore stock portions respectively therein.

9. The gun case as recited in claim 8, wherein each of said U-shaped channels is disposed at an angle relative to horizontal for use in limiting lateral movement of said gun when said gun is supportingly engaged therein.

10. The gun case as recited in claim 1, wherein each of said first and second cradles has a wedge shaped supporting surface for use in limiting lateral movement of said gun when said gun is supportingly engaged thereon.

11. The gun case as recited in claim 9, further comprising at least one lockable strap secured to said lower case portion for use in urging said gun into supportive engagement with said first and second cradles.

12. The gun case as recited in claim 10, further comprising at least one lockable strap secured to said lower case portion for use in urging said gun into supportive engagement with said first and second cradles.

13. The gun case as recited in claim 2, further comprising at least one lockable strap secured to said case for use in urging said gun into supportive engagement with said first and second cradles.

14. The gun case as recited in claim 9, wherein said first cradle is angled away from the second cradle at approximately 13 degrees relative to horizontal, said second cradle is angled away from said first cradle at approximately 3.5 degrees relative to horizontal, and said first and second cradles are displaced by a center length of approximately 24.75 inches.

15. The gun case as recited in claim 10, wherein said first cradle is angled away from second cradle at an angle of approximately 13 degrees relative to horizontal and said second cradle is angled away from said second cradle at an angle of approximately 3.5 degrees relative to horizontal.

16. The gun case as recited in claim 10, wherein said first cradle has a first gun stock engaging upper surface, and said second cradle has a second gun stock engaging upper surface, and said first and second gun stock engaging surfaces are angled away from one another to prevent longitudinal displacement of the gun within the case during transport.

17. In a gun case having rigid walls for storing and transporting a gun having rear and fore stock portions, the combination comprising:

a first cradle disposed within said case;

a second cradle disposed within said case; and said cradle being positioned to supportingly engage said rear stock portion, said second cradle being positioned to supportingly engage said fore stock portion when said gun is disposed within said case for allowing said gun to be maintained in spaced relation from said rigid walls of said case;

wherein each of said first and second cradles has wedge shaped supporting surface for use in limiting lateral movement of said gun when said gun is supportingly engaged thereon;

at least one lockable strap secured to said lower case portion for use in urging said gun into supportive engagement with said first and second cradles; and wherein said lower case portion comprises at least one strap guide having an opening through which said strap passes and wherein said at least on strap guide further includes a curved rib for use in guiding said strap into said opening.

18. In a gun case having a plurality of rigid walls, the combination comprising:

a gun disposed within said case and having rear and fore stock portions in predetermined, spaced relation with respect to one another;

a first U-shaped cradle disposed within said case;

a second U-shaped cradle disposed within said case; and said first U-shaped cradle being positioned at a first location within said case to supportingly engage said rear stock portion, said second U-shaped cradle being positioned at a second location within said case in said predetermined, spaced relation with respect to said first U-shaped cradle to supportingly engage said fore stock portion, said first and second cradles contacting only the respective rear and fore stock portions of the gun and supporting said gun in an upright orientation in spaced relation from each of said rigid walls of said case.

* * * * *